United States Patent [19]

Compton

[11] 4,270,294

[45] Jun. 2, 1981

[54] FIREARMS

[76] Inventor: Robert Compton, 5355 Atlantic, San Angelo, Tex. 76901

[21] Appl. No.: 26,009

[22] Filed: Apr. 2, 1979

[51] Int. Cl.[3] ..... F41C 11/04

[52] U.S. Cl. ..... 42/24

[58] Field of Search ..... 42/24, 23

[56] References Cited

U.S. PATENT DOCUMENTS

| | | | |
|---|---|---|---|
| 88,853 | 4/1869 | Cullen | 42/24 |
| 1,325,400 | 12/1919 | Hochstein | 42/24 |
| 1,402,159 | 1/1922 | Grill | 42/24 |

*Primary Examiner*—Charles T. Jordan

*Attorney, Agent, or Firm*—Joseph H. Schley; Thomas L. Cantrell; Stanley R. Moore

[57] ABSTRACT

Disclosed is a repeating firearm having a vertically slidable block mounted behind the barrel. The upper portion of the block carries a firing pin, and one or more cartridge holding chambers are provided in the lower portion. A cartridge ejector is mounted at the rear of the barrel. The block is slidable between a lower position permitting operation of the ejector, an intermediate position aligning the firing pin with the barrel, and one or more upper positions aligning said cartridge holding chambers with the barrel for transferring cartridges from the chambers to the barrel for firing. In one embodiment a tubular magazine is provided beneath the barrel for holding additional cartridges end-to-end and means are provided for transferring cartridges from the magazine to a cartridge holding chamber in the block, for ultimate transfer therefrom into the barrel.

17 Claims, 16 Drawing Figures

20
21
22
23
24
25
26
27
28
29
30
31
32
33
33A 20
21
23
26
27
28
30
33
34
35
36
37
38
39
40
41
42
43
44
45
46
47
48
50
51
52
53
54
55
56
57
58
58A
59
60
61
62
63
64
65
67
68
69A
69B
69C
3
4
5

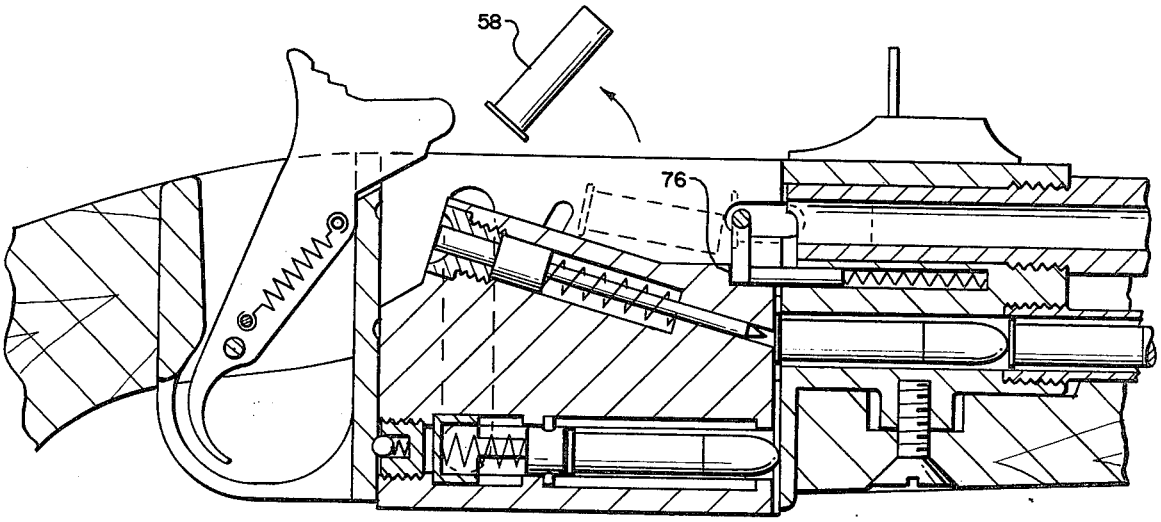
Fig. 6
Fig. 7
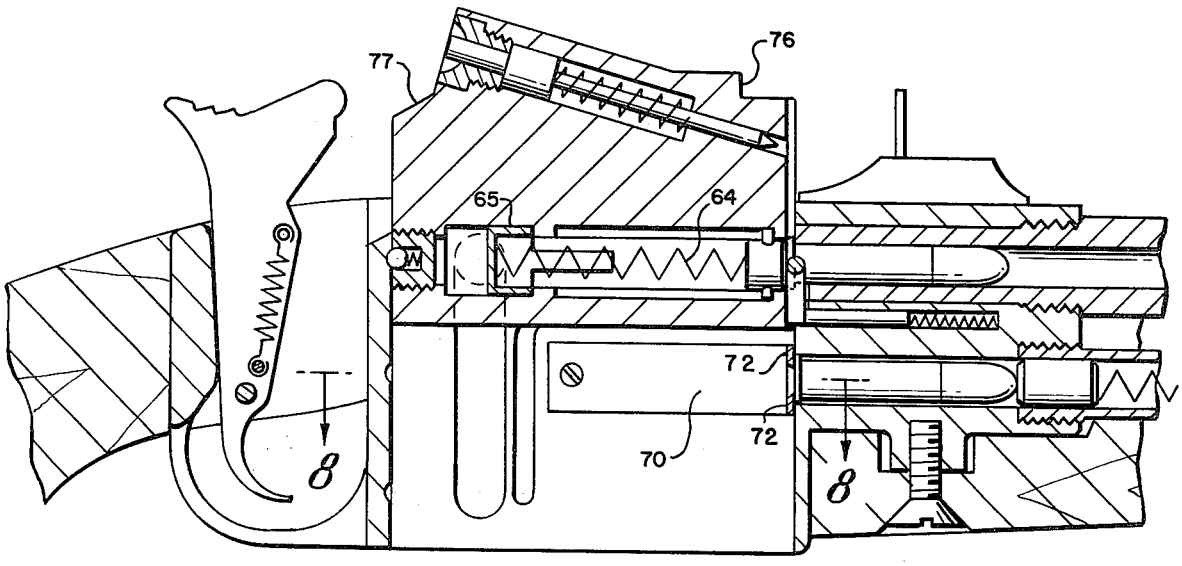

FIREARMS

BACKGROUND OF THE INVENTION

In a repeating firearm it is necessary to provide means for storing cartridges, means for successively delivering them to the barrel, means for firing a cartridge in the barrel, and means for ejecting the spent cartridge. Many systems have been proposed and placed into use for performing these functions, but difficulties have been encountered in providing systems which are strong enough to resist the recoil of a powerful cartridge upon firing, since relatively small lugs are often relied upon to lock a bolt against the end of a barrel. In addition, many systems are complex and prone to jamming.

Some have proposed utilizing vertically sliding blocks or bolts, but such systems have not come into widespread use. Among these are those shown in U.S. Pat. Nos. 2,402,159 to Grill; 290,737 to Brown; 3,733,729 to Baker; and 3,495,349 to Thompson.

SUMMARY OF THE INVENTION

In accordance with the invention, an improved repeating firearm of exceptional strength is provided having a vertically slidable block. A firing pin is mounted in the upper portion of the block, and one or more cartridge holding chambers are provided in the lower portion of the block.The cartridge holding chambers are provided with biasing means for urging a cartridge from the chamber into the end of the barrel. The block is mounted in a slide which provides for reciprocating vertical movement of the block between a lowermost position in which the block is below the level of the barrel to permit ejection of a spent cartridge, an intermediate position in which the firing pin is aligned with the barrel for firing of a chambered cartridge, and one or more upper positions in which a cartridge holding chamber is aligned with the barrel to provide for transfer of a cartridge from the chamber into the end of the barrel for firing.

In accordance with a further aspect of the invention, a tubular magazine for holding one or more additional cartridges may be provided beneath and parallel to the barrel. The tubular magazine is so positioned that it is aligned with a cartridge holding chamber of the block when the block is in its intermediate position in the slide, to provide for delivery or transfer of a cartridge from the tubular magazine to that cartridge holding chamber for ultimitae delivery into the end of the barrel.

In a firearm of the invention equipped with the tubular magazine the basic action is as follows: with a cartridge chambered or seated in the end of the barrel, with a second cartridge positioned in a cartridge holding or transfer chamber, with at least a third cartridge positioned in the magazine adjacent the block, and with the block positioned with the firing pin behind the barrel, the firing pin is actuated by the hammer and trigger to fire the cartridge in the end of the barrel or firing chamber. The block is then lowered to expose the end of the barrel, and the ejector is actuated to extract and eject the spent cartridge. Next, the block is moved to an upper position to bring the cartridge holding or transfer chamber of the block into alignment with the barrel, whereupon the second cartridge is transferred from the cartridge holding chamber into the firing chamber in the end of the barrel. The block is then lowered to return the firing pin to a position behind the barrel and the cartridge holding chamber of the block to a position of alignment with the tubular magazine, whereupon the third cartridge is transferred from the magazine into the cartridge holding chamber. Preferably, the hammer and block are so arranged that the above described movement of the block to the upper position re-cocks the hammer. The firearm is thus once again in ready-to-fire condition.

In a firearm of the invention in which the tubular magazine is omitted, the basic action is quite similar, but somewhat simpler. Assuming the firearm to be one in which the block is provided with two cartridge holding chambers, the basic action is as follows: with a cartridge in the firing chamber of the barrel, with cartridges in each of the two holding chambers of the block, and with the block positioned so that the firing pin is behind the barrel, the firing pin is actuated to fire the cartridge in the firing chamber in the end of the barrel. The block is then lowered to clear the end of the barrel and permit actuation of the ejector to discard the spent cartridge. Next the block is lifted to bring the first cartridge holding chamber in line with the barrel to permit transfer of its cartridge into the firing chamber of the barrel. The block is then lowered to the firing position, and the second cartridge is discharged by actuation of the firing pin. After ejection of the second spent cartridge in the same manner, the block is raised to a still higher level to bring the second cartridge holding chamber in line with the barrel for transfer of its cartridge into the barrel. When the firearm is empty, the block is moved to a low position to permit loading of cartridges into its chamber from the front.

Both the block and the slide of the firearm of the invention are provided with a number of special features, discussed below, for facilitating performance of the basic actions just described.

From the foregoing it can be seen that a primary object of the invention is the provision of a repeating firearm which is sturdy and simple in structure, and reliable in operation. The manner in which this and other objects of the invention are accomplished may best be understood by a consideration of the detailed description which follows, together with the accompanying drawings.

DESCRIPTION OF THE DRAWINGS

FIG. 6 is a fragmentary cross-sectional side elevational view similar to FIG. 2, but with the firearm shown as ejecting a spent cartridge;

FIG. 7 is a fragmentary cross-sectional side elevational view similar to FIGS. 2 and 6, but with the firearm shown as transferring a cartridge into the end of the barrel;

DESCRIPTION OF THE PREFERRED EMBODIMENTS

Figure 1:
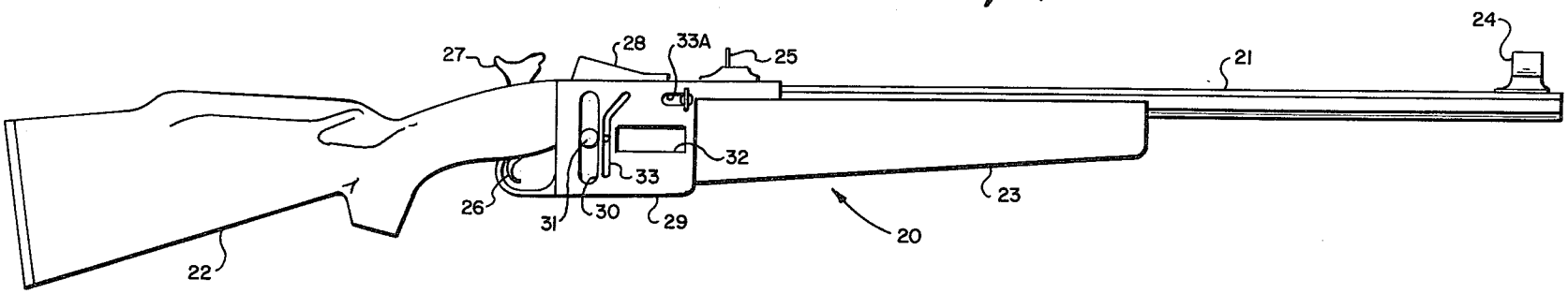
FIG. 1 is a side elevational view of a firearm constructed in accordance with the invention, the embodiment illustrated being one employing a tubular magazine.

In the drawings, FIG. 1 illustrates one firearm constructed in accordance with the invention, which is designated generally as 20. It includes several conventional components, for example, barrel 21, stock 22, forestock or handguard 23, front and rear sights 24, 25, trigger 26, and hammer 27. These elements may be variously arranged without materially impairing the utility of the invention, and the particular arrangement shown in FIG. 1 should be taken as merely illustrative. The barrel 21 may be rifled or smoothbore, and firearm 20 may be designed to fire bullets or to operate as a shotgun.

In accordance with the invention, firearm 20 has a vertically slidable block 28 mounted behind barrel 21 and in front of hammer 27. Block 28 is mounted in slide 29, which has a slot 30 therein to accommodate operating rod 31 of the block, a cartridge loading opening 32, a cartridge seating cam groove 33, and a slot 33A for accommodating the operating lever of an ejector (discussed more fully below).

Figure 2:
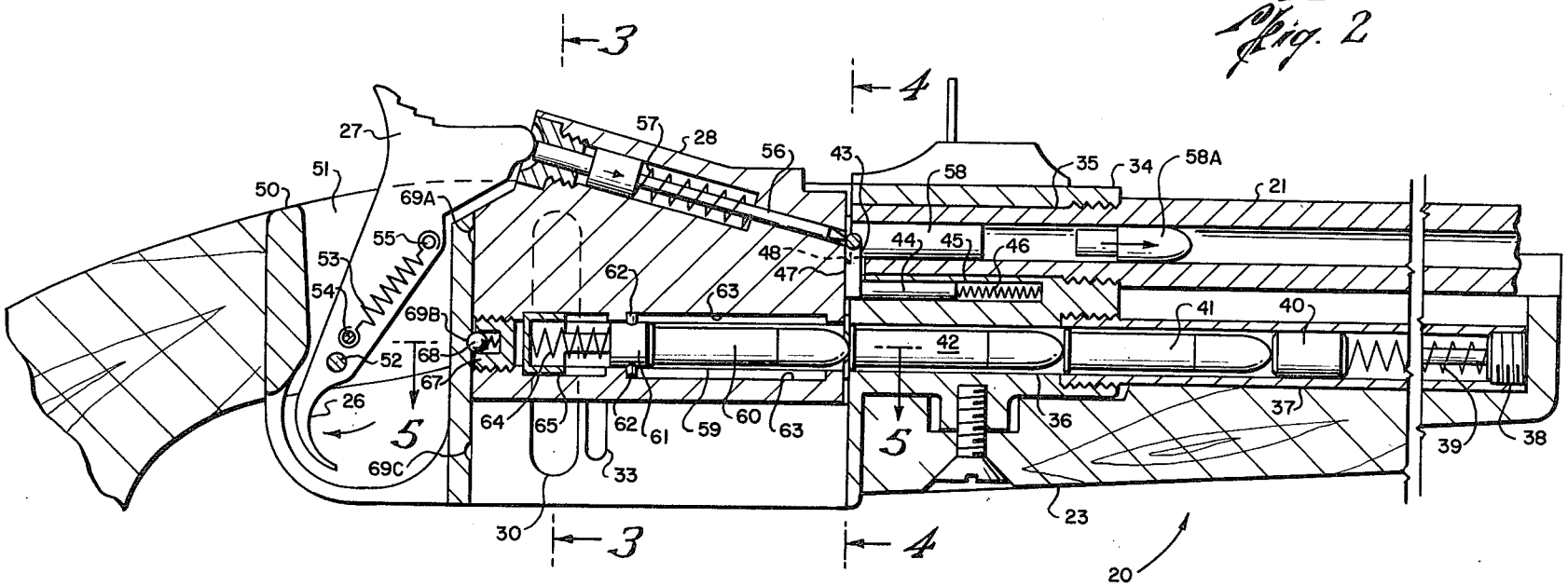
FIG. 2 is a fragmentary cross-sectional side elevational view, on an enlarged scale, of the firearm of FIG. 1, with the firearm shown as having just been fired.

Attention is now directed to FIGS. 2-8 from which the details of this embodiment may be understood. FIG. 2 shows that apart from barrel 21, the primary structural components of the invention are block 28 and slide 29. Slide 29 is provided with a forward extension 34 containing two vertically aligned forwardly facing bores, 35, 36. Barrel 21 is threaded into bore 35. A tubular magazine 37 is similarly threaded into bore 36. The front end of magazine 37 is closed by threaded plug 38, and a spring 39 biases a slidable plug 40 rearwardly in the magazine. Thus cartridges in the magazine, such as 41, 42, will be spring-urged to the rear. The magazine is of a length sufficient to accommodate a selected number of cartridges, and may even be substantially as long as the barrel if desired.

Figure 4:
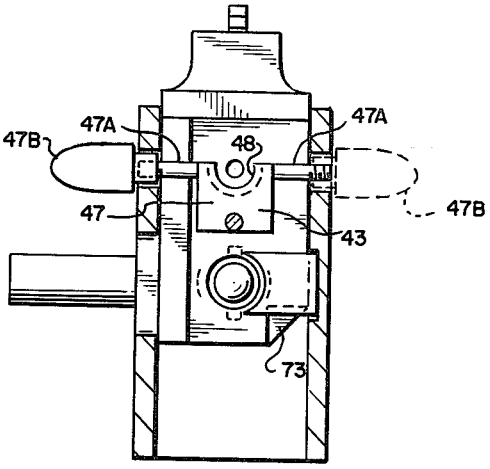
FIG. 4 is another cross-sectional view of the block and slide, the section being taken on the line 4—4 of FIG. 2.

Also mounted in the forward extension 34 is ejector 43, whose structure may best be understood from FIGS. 2 and 4. The ejector includes a shaft 44 slidably mounted in rearwardly facing bore 45 in extension 34. Shaft 44 is biased to the rear in bore 45 by spring 46. The ejector also includes a plate 47 having a semi-circular knife-edged cut-out 48 in the upper edge thereof. The knife edge of cut-out 48 is proportioned to fit under the rim of a cartridge such as 58 chambered in the rear end of barrel 21.

Plate 47 carries outwardly extending operating rods 47A which extend into slots 33A in the slide. On one or the other of the rods is threaded a thumbpiece, 47B, which may be moved from one side of the firearm to the other to convert it for lefthanded use, as is indicated in FIG. 4.

Slide 29 is provided with a hollowed rearward extension 50, the hollow space within the extension forming a trigger compartment 51. In the embodiments shown in the drawings, hammer 27 and trigger 26 are formed as a single piece, which is pivotally mounted on extension 50 by pivot pin 52, and spring biased toward both the firing position (FIG. 2) and the cocked position (FIG. 8) by spring 53 working between pin 54 on extension 50 and pin 55 on hammer 27. Those with ordinary skill in the art will appreciate that other, more elaborate, trigger and hammer systems of known type may be positioned in trigger compartment 51, including those incorporating safety mechanisms, and that a simple system is shown here merely for illustrative purposes.

The structure of block 28 can best be understood from FIGS. 2-5 and 8.

Block 28 has a firing pin 56 slidably mounted in the upper end thereof. The firing pin is biased rearwardly, away from the barrel, by spring 57. In FIG. 2 it is generally aligned with the barrel so that the point of the pin is in proper position to strike the primer of a center-fire cartridge, such as 58, chambered in the rear portion of the barrel for firing. However, the pin is not fully axially aligned with the barrel, but rather slants upwardly to the rear somewhat.

In the lower portion of block 28 is cartridge holding and transfer chamber 59, shown in FIG. 2 as containing a cartridge 60. Behind the cartridge in the chamber is a slidable plug 61. The plug has ears 62 on its top and bottom, which run in grooves 63 above and below chamber 59. It should be noted that grooves 63 terminate short of the front of chamber 59, to limit forward travel of plug 61, and at the rear of the chamber, to limit its rearward travel.

Plug 61 is biased forwardly in chamber 59 by spring 64. A consideration of FIG. 2 will reveal that when chamber 59 is aligned with magazine 37, spring 64 will be opposing spring 39. As will be explained below, when chamber 59 is in its FIG. 2 position, and is empty, it is desired in accordance with the invention to force the rearmost cartridge 42 in the magazine rearwardly into chamber 59. As a consequence, spring 64 is necessarily weaker than spring 39 of the magazine.

Figure 5:
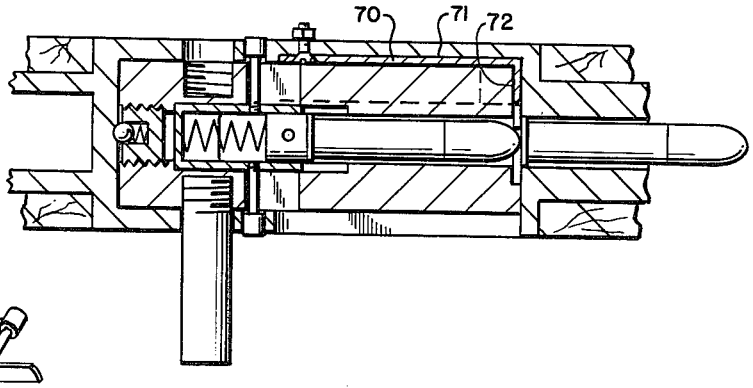
FIG. 5 is a fragmentary cross-sectional plan view of the block, slide, and a portion of the magazine, the section being taken on the line 5—5 of FIG. 2.
Figure 5A:
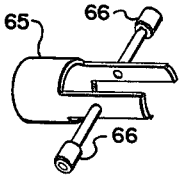
FIG. 5A is an isolated perspective view of a cartridge transfer element positioned in a cartridge holding and transfer chamber of the block.

A consideration of FIG. 7, on the other hand, will reveal that spring 64 provides the impetus to move a cartridge from the transfer chamber 59 into the firing chamber or rear portion of barrel 21. The spring 64 thus has somewhat contradictory demands placed upon it. It must be weak enough to permit loading of chamber 59 from the magazine, and strong enough to empty the chamber into the barrel. In order to better meet these demands, a hollow cam driven piston 65 is mounted in the rear portion of chamber 59, and spring 64 is mounted in it. As can best be seen from FIGS. 5 and 5A, piston 65 has cam rods 66 projecting from either side thereof, which run in cam slots 33 (See also FIG. 1). Cam slots 33 are curved forwardly and upwardly, so that when block 28 is raised, as in FIG. 7, to bring chamber 59 into alignment with the barrel, piston 65 is moved forward to shorten the distance that spring 64 must expand in order to successfully seat a cartridge in the firing chamber.

On the other hand, when the block 28 is in a position with chamber 59 aligned with the magazine, as in FIG. 2, piston 65 is cammed to its rearmost position, and spring 64 has relatively more distance in which to compress in response to force applied by magazine spring 39.

The rear end of chamber 59 is closed by plug 67, which carries a spring loaded ball 68. The back wall of slide 29 has three detents 69A, 69B, and 69C in it, and a comparison of FIGS. 2, 6 and 7 will reveal that when block 28 is in its three primary operative positions, ball 68 is seated in one of the detents.

As can be seen from FIG. 7, when block 28 is in its uppermost position, the end of magazine 37 is open, and the magazine spring would expel the cartridges from the magazine unless some restraint were supplied. L-shpaed spring 70, mounted in a cut-out 71, in the left-hand interior sidewall of slide 29 performs this function. When block 28 is in its uppermost position, as in FIGS. 7 and 8, the spring 70 flexes to bring its leg 72 partially across the end of the magazine 37 (or, more precisely, bore 36) to restrain the expulsion of the shells therein.

As can be seen from FIG. 4, the lower right hand corner of block 28 is cut off, as at 73, to provide a camming surface for camming spring 70 back into cut-out 71 upon movement of block 28 downwardly to its intermediate position (FIGS. 2, 4, 5) or lowermost position (FIG. 7).

Figure 8:
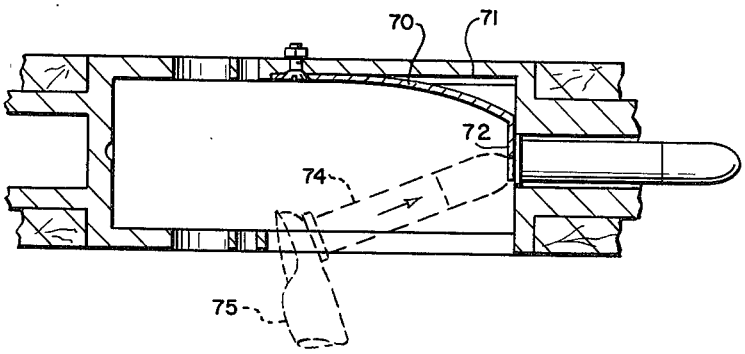
FIG. 8 is a fragmentary cross-sectional view of the lower portion of the slide and a portion of the magazine, the section being taken on the line 8—8 of FIG. 7.

FIG. 8 shows that with block 28 in its uppermost position, cartridges can be fed into the magazine through opening 32 in the right hand sidewall of slide 29. As the phantom cartridge 74 and finger 75 indicate, the spring 70 is cammed away from the magazine by the nose of the bullet.

Figure 3:
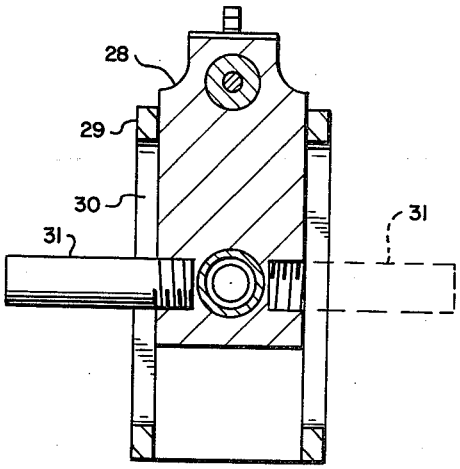
FIG. 3 is a cross-sectional view of the block and slide of the firearm of FIGS. 1 and 2, the section being taken on the line 3—3 of FIG. 2.

As was mentioned above, block 28 is provided with an operating rod 31, which works in slot 30 of the slide. By providing such a slot on both sides of the slide, as shown in FIG. 3, provision is made for readily converting the firearm from righthand (full lines) to lefthand (dashed lines) operation.

With the foregoing description of the construction of the firearm 20 of FIG. 1 in hand, a description of its operation can now be given, with special reference to FIGS. 2, 6 and 7.

FIG. 2 shows the firearm just after the moment of firing. Bullet 58A has left cartridge 58 and is proceeding down the barrel. Block 28 is in its intermediate position with the firing pin generally aligned with the barrel. The firing pin has been driven forward by the hammer. Cartridge 60 is in transfer chamber 59, and additional cartridges 41, 42 are in tubular magazine 37.

Next, block 28 is lowered by means of its operating rod 31 (FIG. 1) to the position shown in FIG. 6, i.e. its lowermost position. The ejector springs back to pull spent cartridge 58 out of the firing chamber of the barrel. Rearward movement of the ejector is stopped by notch 76 on block 28. The firing pin retracts as it moves away from the hammer.

The block is then raised to the position shown in FIG. 7, i.e. its uppermost position, with transfer chamber aligned with the barrel. In order to raise the block, it is necessary to push the ejector forward and hold it there until raising of the block is completed. Hammer 27 is cocked by the camming action of notch 77 at the back of the block. As the block is raised, hollow piston 65 is cammed forward in chamber 59, further compressing spring 64. When chamber 59 comes into alignment with the barrel, spring 64 expands from its compressed state to drive cartridge 60 into the firing chamber in the end of the barrel.

Finally, block 28 is lowered once again to the intermediate position shown in FIG. 2 with the firing pin generally aligned behind the barrel and with chamber 59 aligned with the magazine. Magazine spring 39 pushes the rearmost cartridge backwardly into chamber 59. During lowering of the block, hollow piston 65 is cammed to its rearmost position in chamber 59.

The firearm is now substantially in the condition shown in FIG. 2, except that its inventory of cartridges is reduced by one, its hammer is cocked, and its firing pin is retracted. It is ready to fire.

Figure 9:
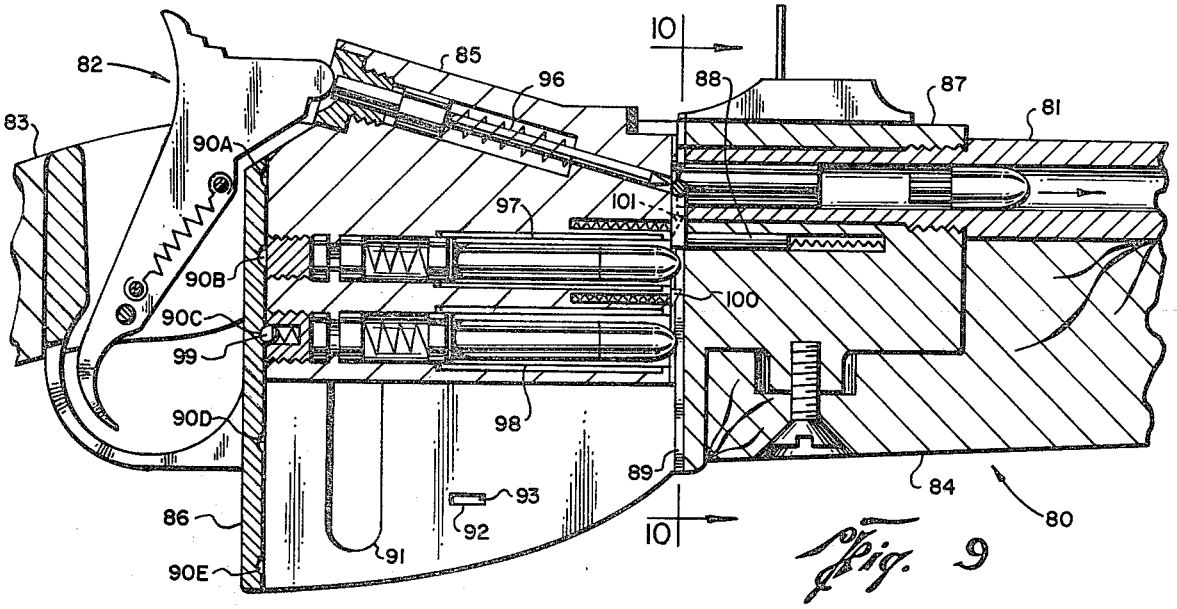
FIG. 9 is a fragmentary cross-sectional side elevational view of an alternate embodiment of the invention, which employs no tubular magazine.
Figure 10:
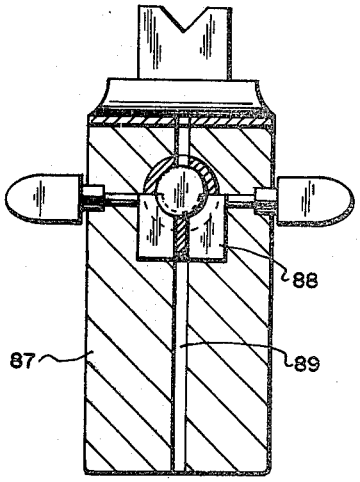
FIG. 10 is a cross-sectional view taken on the line 10—10 of FIG. 9.
Figure 11:
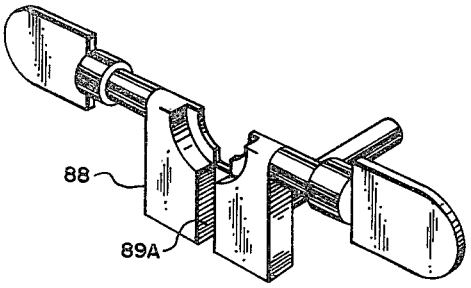
FIG. 11 is an isolated perspective of the ejector of the firearm of FIG. 9.

Attention is next directed to FIGS. 9–13, which show another embodiment of the invention, which differs from the embodiment discussed above primarily in the ommission of the tubular magazine. Instead, provision is made for storing cartridges in the block itself. This has the disadvantage that the number of stored rounds is limited to a relatively small number, perhaps as many as four, but the countervailing adavantage that more pointed bullets may be fired, since at no time are cartridges in head-to-toe relationship, with the nose of one bullet in contact with the center-fire primer of another. The firearm of FIG. 9 is thus more attractive for target use, where round storage capacity is of small importance, while the firearm of FIG. 2 is more attractive for field use, where large magazine capacity is considered desirable.

Many of the parts and their functions are identical, or nearly identical, in the firearms of FIGS. 9 and 2, and reference is therefore made to the above description of the FIG. 2 embodiment for a full understanding of the FIG. 9 embodiment. The discussion here will be concentrated upon the respects in which the FIG. 9 embodiment differs from that of FIG. 2, and upon its mode of operation.

The firearm of FIG. 9 is designated generally as 80. It includes a barrel 81, hammer and trigger assembly 82, stock 83 and handguard 84. It is equipped with a vertically sliding block 85 working in slide 86. Slide 86 is provided with a forward extension 87, into which barrel 81 is threaded, and in which ejector 88 is mounted. The front wall of slide 86 has a central slot 89 running vertically throughout its height, and ejector 88 has a corresponding slot 89A.

As can be seen from FIG. 9, slide 86 is deeper than slide 29 (FIG. 2) and its lower portion is open to the front. It is provided with five detent notches 90A-E to establish five operating positions for block 85. In addition to operating rod slot 91, the left sidewall of slide 85 has a keeper slot 92 through which keeper tab 93 protrudes. The function of keeper tab 93 is to disable block 85 from sliding to its lowermost position except when tab 93 is deliberately withdrawn to permit such movement.

Figure 13:
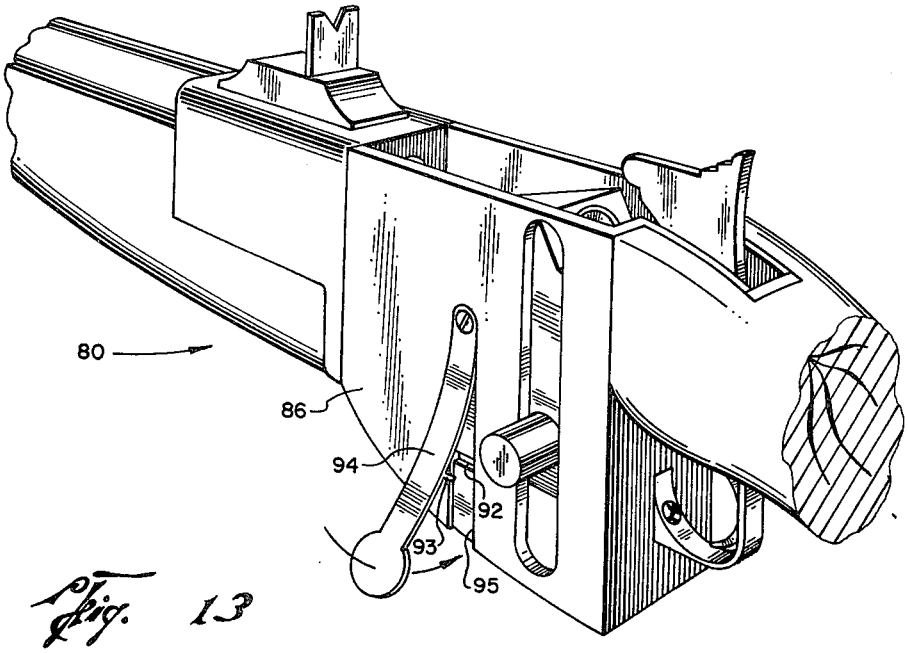
FIG. 13 is a fragmentary left side perspective view of the firearm of FIG. 9.

The structure of the keeper tab mechanism is illustrated in FIG. 13. Tab 93 is mounted on leaf 94, which fits in groove 95. When leaf 94 is relaxed, tab 93 protrudes through slot 92 into the interior of slide 86. When leaf 94 is flexed outwardly, as in FIG. 13, tab 93 is withdrawn from slot 92, and block 85 can be moved downwardly to its lowermost position.

Block 85 (FIG. 9) is provided with a firing pin 96 in its upper portion, and two cartridge holding chambers 97, 98 in its lower portion. The cartridge chambers are spring loaded to urge the cartridges positioned in them forwardly. The cap closing the rear end of chamber 98 is equipped with a spring loaded ball 99, which works in detent notches 90A–E. Above each chamber at the front of block 85 are spring loaded latches 100, 101, which run in groove 89 of the slide. The latches prevent any attempt to chamber a cartridge if there is a round already in the firing chamber, by catching on the rim of that round and stopping further upward movement of the block.

Figure 12:
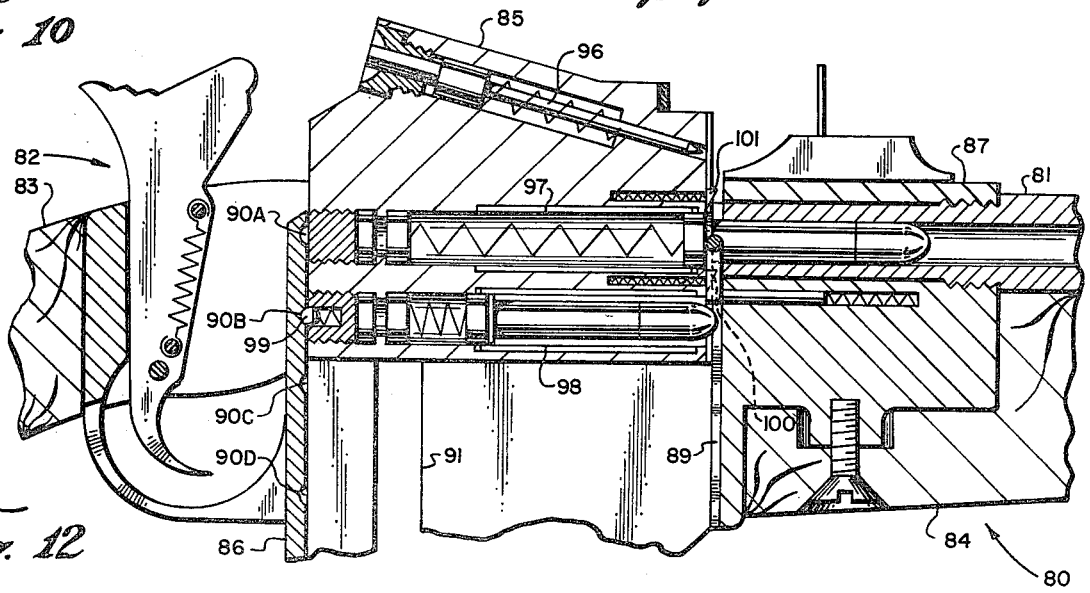
FIG. 12 is a fragmentary cross-sectional side elevational view, similar to FIG. 9, but with the firearm shown in the process of transferring a cartridge into the firing chamber of the barrel.

The operation of this embodiment may be seen from FIGS. 9 and 12. In FIG. 9, the block is positioned with the firing pin generally aligned with the barrel. The hammer has struck the pin to fire the cartridge in the chamber.

The block is then lowered to a postion much like that shown in FIG. 6, to permit ejection of the spent cartridge, and then raised to the position shown in FIG. 12. In that position the cartridge in chamber 97 is inserted into the barrel, and the hammer is cocked.

The block is lowered again to the FIG. 9 position, and fired. Once more the block is lowered to the FIG. 6 position to eject the spent cartridge. It is then raised to its uppermost postion to chamber the cartridge carried in chamber 98 and re-cock the hammer. Then it is returned to the FIG. 9 position for firing.

When all cartridges have been fired, leaf 94 (FIG. 13) if flexed to withdraw tab 93, and the block is moved to its lowermost position. Two cartridges are inserted into chambers 97 and 98, and one is inserted directly into the firing chamber. The block is returned to its FIG. 9 position, the hammer is manually cocked, and the firearm is again ready to fire.

Figure 14:
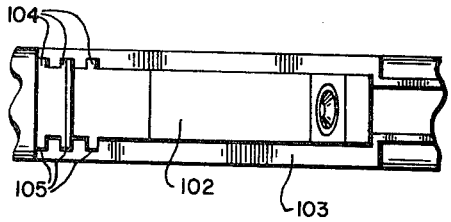
FIG. 14 is a fragmentary top view of another alternate embodiment.
Figure 15:
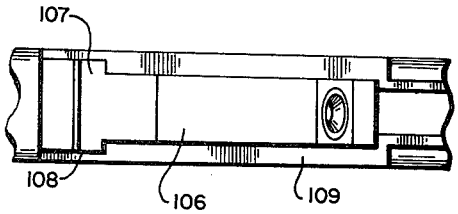
FIG. 15 is a fragmentary top view of still another alternate embodiment.

FIGS. 14 and 15 show alternate configurations for the block and slide which may be employed in connection with the embodiments of either FIG. 2 or FIG. 9. In FIG. 14, block 102 has a series of rails 104 which slidingly fit in grooves 105 in slide 103 to enhance strength immediately behind the barrel. In FIG. 15, the same object is achieved by thickening block 106, as at 107, to slidingly fit in the enlarged space 108 of slide 109.

From the foregoing it can be seen that a strong, simple, easily operated firearm has been provided.

I claim:

1. A firearm comprising:

a barrel;

a vertically slidable block mounted behind said barrel, said block having a firing pin mounted in the upper portion thereof, and further havng at least one cylindrical cartridge holding chamber in the lower portion thereof;

a vertically oriented slide for holding said slidable block against horizontal movement while permitting selective vertical movement of the block between an intermediate position in which said firing pin is generally aligned with said barrel, an upper position in which said cartridge-holding chamber is aligned with said barrel, and a lower position in which said block is below the end of said barrel;

hammer means positioned behind said slide; and spent cartridge ejector means mounted on said slide adjacent the rear end of said barrel, but forward of said slidable block.

2. A firearm in accordance with claim 1 in which the slide is open to the front in its lower portion, and in which said block is vertically movable to an additional and still lower position in which said cartridge-holding chamber is aligned with said frontwardly open portion of said slide, to facilitate loading of a cartridge therein.

3. A firearm in accordance with claim 2 and further comprising releasable means mounted on said slide normally restraining said block against movement to its additional and still lower position.

4. A firearm in accordance with claim 3 in which said restraining means comprise a leaf spring mounted exteriorly on said slide, a slot in a wall of said slide, and a tab on said spring normally urged thereby through said slot into said slide beneath said block.

5. A firearm in accordance with claim 1 and further comprising means mounted on said block for preventing movement thereof to its upper position when a cartridge is positioned in said barrel.

6. A firearm in accordance with claim 5 in which said block movement preventing means comprise a latch on said block biased forwardly into a slot on the front of said slide in position to catch on the rim of a cartridge in the end of said barrel upon upward movement of said block.

7. A firearm in accordance with claim 1 and further comprising a tubular magazine positioned beneath said barrel, said magazine having a length sufficient to accommodate at least one cartridge, said magazine being aligned with the cartridge-holding chamber of said block when the block is in its intermediate position.

8. A firearm in accordance with claim 7 further comprising:

means in said magazine for urging cartridges located therein toward said block; and means in said cartridge holding chamber for urging a cartridge therein toward said barrel.

9. A firearm in accordance with claim 8 in which the cartridge urging means in said cartridge-holding chamber comprises a bias spring and means for camming said bias spring toward said barrel upon movement of said block from its intermediate position to its upper position.

10. A firearm in accordance with claim 9 in which said camming means comprise a piston in said cartridge-holding chamber adjacent the rear end thereof, said bias spring being mounted thereon, a cam rod projecting from said piston, and a cam slot in said slide engaging said cam rod.

11. A firearm in accordance with claim 7 and further comprising spring means mounted in said slide for blocking the rear end of said magazine when said block is in its upper position, and camming means on said block for camming said spring means out of the path of movement of said block upon downward movement thereof.

12. A firearm in accordance with claim 7 in which said slide has a cartridge loading opening in a side wall thereof.

13. A firearm in accordance with claim 1 in which said slide has a vertical operating slot therein and said block has an operating rod mounted thereon and projecting through said slot.

14. A firearm in accordance with claim 13 in which said slide has an operating slot on each side thereof, and said operating rod in selectively mountable on said block through either of said slots.

15. A firearm in accordance with claim 1 in which said ejector means comprise an arcuate collar engagable with the rim of a cartridge positioned in said barrel, spring means biasing said collar rearwardly, and thumbpiece projecting from said collar for facilitating forcing said collar forwardly against its spring means.

16. A firearm in accordance with claim 15 in which said thumbpiece is selectively positionable on either side of said collar.

17. A firearm in accordance with claim 1 in which said block has camming means thereon engagable with said hammer for cocking thereof.

* * * * *